US011219872B2

(12) United States Patent
Roe

(10) Patent No.: US 11,219,872 B2
(45) Date of Patent: Jan. 11, 2022

(54) SYSTEM AND METHOD FOR STABLY INFUSING GAS INTO LIQUID, AND FOR DELIVERING THE STABILIZED GAS-INFUSED LIQUID INTO ANOTHER LIQUID

(71) Applicant: GAPS TECHNOLOGY, LLC, Slidell, LA (US)

(72) Inventor: Cliffton Lee Roe, Harrison Township, MI (US)

(73) Assignee: Gaps Technology LLC., Slidell, LA (US)

( * ) Notice: Subject to any disclaimer, the term of this patent is extended or adjusted under 35 U.S.C. 154(b) by 52 days.

(21) Appl. No.: 16/665,404

(22) Filed: Oct. 28, 2019

(65) Prior Publication Data

US 2020/0061549 A1 Feb. 27, 2020

Related U.S. Application Data

(62) Division of application No. 15/591,422, filed on May 10, 2017, now Pat. No. 10,486,115.

(51) Int. Cl.

| | |
|---|---|
| ***B01F 3/04*** | (2006.01) |
| ***B01F 3/08*** | (2006.01) |
| ***B01F 3/20*** | (2006.01) |
| *B01F 13/10* | (2006.01) |
| *B05B 1/00* | (2006.01) |
| *B01F 5/10* | (2006.01) |

(52) U.S. Cl.

CPC ..... *B01F 3/04751* (2013.01); *B01F 3/04985* (2013.01); *B01F 3/0876* (2013.01); *B01F 3/2021* (2013.01); *B01F 3/2057* (2013.01); *B01F 5/106* (2013.01); *B01F 13/1025* (2013.01); *B01F 2003/04858* (2013.01); *B05B 1/00* (2013.01)

(58) Field of Classification Search

CPC .. B01F 3/0876; B01F 3/04751; B01F 3/2057; B01F 3/04985; B01F 3/2021; B01F 2003/04858; B01F 5/106; B01F 13/1025; B05B 1/00

See application file for complete search history.

(56) References Cited

U.S. PATENT DOCUMENTS 3,531,050 A * 9/1970 Stanley ..... B05B 7/0466 239/427.3
5,069,073 A * 12/1991 Barrett ..... G01L 19/0007 73/756
5,569,180 A 10/1996 Spears
6,029,714 A * 2/2000 Imamura ..... B21C 1/24 138/177

(Continued)

FOREIGN PATENT DOCUMENTS

EP 2 116 589 A1 11/2009

*Primary Examiner* — Stephen Hobson

(74) *Attorney, Agent, or Firm* — Carrier Blackman & Associates, P.C.; Joseph P. Carrier; William D. Blackman

(57) ABSTRACT

A system for stabilizing gas-infused liquid, includes a tubular flow path configured to receive and pass therethrough the gas-infused liquid under a pressure of at least 20 psi, wherein a surface of the flow path configured to engage the gas-infused liquid flowing through the flow path is formed of material having a surface roughness (Ra) in a range of 0.1 μm-10.0 μm, and the flow path has a length which is at least 100 times a mean inner diameter thereof.

10 Claims, 4 Drawing Sheets

(56) References Cited

U.S. PATENT DOCUMENTS

| | | | | |
|---|---|---|---|---|
| 6,054,048 | A * | 4/2000 | Kaeriyama | B01F 5/0206 210/220 |
| 7,008,535 | B1 | 3/2006 | Spears et al. | |
| 7,137,620 | B2 * | 11/2006 | Thomas | A01K 63/042 261/77 |
| 7,294,278 | B2 | 11/2007 | Spears et al. | |
| 8,317,165 | B2 | 11/2012 | Yamasaki et al. | |
| 8,821,160 | B2 | 9/2014 | Choi | |
| 9,308,505 | B2 * | 4/2016 | Spears | C02F 3/02 |
| 9,527,046 | B1 | 12/2016 | Roe | |
| 9,550,156 | B2 * | 1/2017 | Chien | B01F 5/106 |
| 10,052,596 | B2 * | 8/2018 | Richardson | B01F 5/0415 |
| 2007/0040288 | A1 * | 2/2007 | Emilsen | B01F 5/0471 261/76 |
| 2007/0189972 | A1 | 8/2007 | Chiba et al. | |
| 2011/0301531 | A1 * | 12/2011 | Spears | B01F 3/04758 604/24 |
| 2016/0228834 | A1 | 8/2016 | Roe | |
| 2016/0236158 | A1 | 8/2016 | Bauer | |
| 2018/0043316 | A1 * | 2/2018 | Anker | C02F 3/20 |

* cited by examiner

SYSTEM AND METHOD FOR STABLY INFUSING GAS INTO LIQUID, AND FOR DELIVERING THE STABILIZED GAS-INFUSED LIQUID INTO ANOTHER LIQUID

CROSS-REFERENCE TO RELATED APPLICATIONS

The present application is a divisional of U.S. patent application Ser. No. 15/591,422, filed May 10, 2017. The entire subject matter of this priority document, including specification claims and drawings thereof, is incorporated by reference herein.

BACKGROUND OF THE INVENTION

Field of the Invention

The present disclosure relates to a system and method for stably infusing gas into liquid in the form of nanobubbles, and for efficiently delivering the stabilized, gas-infused liquid into another liquid, e.g., for treatment of the other liquid. More particularly, the present disclosure relates to such a system and method which can efficiently and stably infuse gas into liquid at very high, supersaturated levels and for long duration, and which can also efficiently discharge the stabilized, gas-infused liquid into another liquid for treatment of the other liquid and other purposes.

Background

Systems and methods have long been known that infuse gas into liquids under pressurized conditions for various purposes, including adding carbonation to beverages. Some such known systems and methods operate under very high pressures of 100 psi and more, and in general the higher the pressure at which the system/method operates the greater the amount of gas that may be infused into the liquids. However, when the gas-infused liquids are brought to ambient temperature (0-25° C.) and ambient pressure (100 kPa), most of the infused gasses tend to be released from the liquids in a fairly short time, e.g., within hours or days.

There are also known systems and methods for stabilizing gas-infused liquids such that the infused gasses remain in the liquids for extended periods of days, weeks, and months after the liquids are brought to ambient temperature and pressure at much higher levels than predicted by Henry's Law. Generally this involves subjecting a gas-infused liquid to some type of physical and/or other treatment which reduces the size of the gas bubbles infused in the liquid, noting that the smaller the size of gas bubbles infused in the liquid the more stably the bubbles remain in the liquid at ambient temperature and pressure. Very small gas bubbles are often referred to as nanobubbles. Nanobubbles are normally only associated with water or aqueous based solutions. Generally, bubbles having a size of 0.5-200 nm are considered nanobubbles. Nanobubbles tend to stably remain in water or aqueous solution much longer than larger bubbles, and the smaller the nanobubble the greater the concentration they can be infused into the water or aqueous solution. Throughout this disclosure references to "water" in which gas is to be infused and/or nanobubbles are to be formed encompasses not only water per se, but any aqueous solution containing water. Additionally, the systems and methods according to the present invention are not limited to infusing gas into and/or forming nanobubbles in water or aqueous solutions, and may be applied for stably infusing vasious gasses into non-aqueous liquids.

For example, some such systems for stabilizing gas-infused liquids are disclosed in: U.S. Pat. Nos. 5,569,180, 7,008,535 Bland U.S. Pat. No. 9,308,505 B2 to Spears et al. which involve a flow path-nozzle including one or more capillary tubes through which a gas-infused liquid may be passed under pressure; US 2016/0236158 A1/WO2015/048904 A1 to Bauer which disclose another type of stabilization device for gas-infused liquids involving a length of tubing through which a high pressure gas-infused liquid is passed and a series of space, substantially circular disks disposed within the tubing so as to generate at least two cavitation zones and shear planes which greatly agitates the gas-infused liquid as it flows through the tubing and theoretically forms the gas into extremely small, nano-sized bubbles (50-60 nm); US2007/0189972 A1/WO2005084718 A1 to Chiba et al. which discloses another type of stabilization device for gas-infused liquids involving various means, including discharge of static electricity through the liquid, ultrasonic agitation of the liquid, physical agitation of the liquid, compression, expansion and vortex flow of the liquid, and passing the liquid through an orifice or perforated plate; and EP2116589 A1 to Shiode et al. which discloses another type of stabilization device for gas-infused liquids involving ejection of the gas-infused liquid under high pressure though one or more nozzles into a tank of liquid having a solid wall therein against which the injected gas-infused liquid impacts.

While such known systems may be appropriate for stabilizing gas-infused liquids, there are limitations associated therewith. For example, the systems/methods disclosed in the patents to Spears et al. are limited to use with relatively pure, low viscosity liquids because the capillary tubes used therein tend to get readily clogged by liquids with impurities such as suspended solids and high viscosity liquids. As another example the systems and methods of Chiba et al. are relatively complex.

The present inventor has also previously proposed some such systems and methods. e.g., in U.S. Pat. Nos. 9,527,046 B2 and 9,586,186 B2, which avoid the limitations of these other known systems and methods. The systems and methods disclosed in U.S. Pat. Nos. 9,527,046 B2 and 9,586,186 B2 involve flowing the gas-infused liquids through tubular flow paths having a series of alternating straight and curved sections such that coarse gas bubbles in the liquids are efficiently broken up when flowing through the curved sections and compressed into very small, e.g., nano size, bubbles when flowing through the straight sections, with the resulting very small bubbles being much more stabily infused in the liquids that the coarse gas bubbles that were originally infused. The disclosures of U.S. Pat. No. 9,527,046 B2 and 9,586,186 B2 are incorporated herein by reference.

As is also known, there are many purposes to which stabilized, gas-infused, nanobubble-containing liquids may be usefully applied, including admixing or injecting the nanobubble-containing liquid into: municipal wastewater and other contaminated water sources to promote microbial decomposition of organic contaminants in the wastewater and other contaminated water sources; water containing oil and/or oil-water emulsions to promote separation of the hydrocarbons from the water; water containing dissolved salts and/or shale (fracking water) to promote precipitation of the salts and shale from the fracking water; water containing suspended solids to promote separation of the suspended solids from the water; and various aqueous based solutions to change the pH thereof to facilitate separation of materials from the solutions by coagulation, polymerization, salt formation, crystallization, and/or effervescence.

When so utilizing the stabilized, gas-infused liquids there are important factors to consider and address, including discharging the stabilized, gas-infused liquid into another liquid or otherwise combining the stabilized, gas-infused liquid with another liquid in such a manner that: does not cause the infused gas to be de-stabilized and prematurely released from the liquids; and permits the stabilized, gas-infused liquid to the delivered to specific or targeted parts of the other liquid. For example, in U.S. Pat. No. 5,569,180 to Spears it is discussed that desirable to discharge the stabilized, gas-infused liquids into various receiving liquids in a manner which does not cause cavitation at the point where the gas-infused liquid is being discharged because cavitation would undesirably release some of the infused gas in the form of small bubbles into the receiving liquid. Not only is it generally undesirable for some of the gas to be quickly prematurely, but for some applications release of such gas bubbles is completely unacceptable, e.g., if an oxygen infused aqueous solution is being infused into the bloodstream of a living mammal, release of small gas bubbles in the bloodstream could be fatal for the mammal.

In the systems and methods disclosed in U.S. Pat. No. 5,569,180 to Spears et al., it is disclosed to discharge the stabilized, gas-infused liquids into various receiving liquids via one or a plurality of capillary tubes at the discharge end, as well as elimination of cavitation nuclei along the discharge channels through which the gas-infused liquid flows, and that by doing so they are able to avoid cavitation at the point where the gas-infused liquid is being discharged. Again, however, use or capillary size discharge channels is limited to use with relatively pure, low viscosity liquids because the capillary tubes tend to get readily clogged by liquids with impurities such as suspended solids and high viscosity liquids.

Although the present inventor's previously disclosed improvements as discussed above provide significant advantages over the other previously known systems and methods, desiderata still exist in the art for further simplifying the structure and operation of a system/method for stabilizing gas-infused liquids, as well as for efficiently discharging the stabilized, gas-infused liquid into another liquid for treatment of the other liquid and other purposes without causing cavitation or generation of gas bubbles.

SUMMARY OF THE INVENTION

The present invention has been created with the object of satisfying the discussed desiderata.

According to a first aspect of the present invention there is provided a system for stabilizing gas-infused liquid which comprises a flow path configured to receive and pass therethrough the gas-infused liquid under a pressure of at least 20 psi, wherein a surface of the flow path configured to engage the gas-infused liquid flowing through the flow path is formed of material having a surface roughness (Ra) in a range of 0.1 μm-10.0 μm and the flow path has a length which is at least 100 times as long as a mean inner diameter thereof. If the material forming the inner surfaces of the flow path has a surface roughness Ra of less than 0.1 μm, e.g., materials such as silica based glass or plastics, the material will not be sufficiently rough to break up bubbles of gas infused in the liquid flowing through the flow path, which is a necessary part of the stabilization process as discussed further herein. On the other hand if the material forming the inner surfaces of the flow path has a surface roughness Ra of more that 10.0 μm, e.g., materials such as carbon steel, galvanized steel, cast iron, and concrete, the material will be excessively rough and cause too much turbulence in the liquid stream as it flows along the flow path, it will not be effective for forming the infused gas into very small, stable bubbles as discussed further herein.

The flow path may be substantially linear or may be curved or include one or more radial bends therein, although the flow of liquid through the flow path should be substantially smooth, consistent and laminar.

With such flow path according to the present invention, as a stream of the pressurized, gas-infused liquid passes through the flow path, a central portion of the liquid stream flows at a higher rate and a more uniform manner than an outer portion of the stream which engages surfaces of the flow path. These differences cause the gas which has been infused into the liquid to be compressed into smaller and smaller bubbles, and correspondingly more and more stably infused in the liquid, as the liquid stream flows along the length of the flow path. As will be recognized such a flow path according to the present invention has relatively simple structure/configuration in comparison to other conventionally known devices and systems used for stabilizing a gas-infused liquid, including those previously proposed by the present inventor.

Although the exact process whereby the gas bubbles are reduced in size, to become more stably infused in the liquid, as the pressurized liquid passes through the flow path may not be fully understood, it is believed that: the outer portions of the liquid stream are agitated through engagement with the surfaces of the flow path, which breaks up the gas bubbles in the outer portions of the liquid stream; the outer portions of the liquid stream are also caused to roll toward and mix into the center of the liquid stream; and while flowing along in the center portion of the liquid stream the gas from the bubbles which have been broken up is compressed into new, smaller size bubbles. These actions are repeated as the liquid stream continues to flow along the flow path, causing the infused gas in the liquid to be compressed into smaller and smaller size bubbles. Generally, by forming the surfaces of the flow path configured to engage the gas-infused liquid of material having a surface roughness (Ra) in a range of 0.1 μm-10.0 μm, and making the flow path at least at least 100 times as long as a mean inner diameter thereof, this assures that the gas bubbles will be reduced to a sufficiently small size on the order of 200 nanometers or less when they are passed completely through the flow path under a pressure of at least 40 psi, whereby the infused gas will stably remain in the liquid for at least a few weeks up to 2-3 months if the liquid is brought up to ambient temperature and pressure.

According to a second aspect of the invention, in addition to the first aspect, there is provided a nozzle for discharging a pressurized, stabilized, gas-infused liquid into a receiving liquid while minimizing release of any infused gas, the system comprising: a first tube having one end configured to be connected to a source of pressurized, stabilized, gas-infused liquid and a second end from which the liquid is discharged; a second tube which is fixed in surrounding relation to at least a portion of the first tube with a space therebetween and which includes an open discharge end which extends further downstream in a direction of liquid flow through the nozzle than the second end of the first tube, wherein the first tube has an opening defined in a sidewall thereof, the second tube has an opening defined in an outer wall thereof, and the opening in the side wall of the first tube is disposed further downstream in the direction of liquid flow through the nozzle than the opening in the side wall of the second tube.

In use such discharge nozzle according to the present invention would be at least partially submerged in the receiving liquid, including the second end of the first tube, the discharge end of the second tube and portions of the first and second tubes having the openings defined in the side walls thereof, such that the receiving liquid fills the space between the submerged portions of the first and second tubes. The receiving liquid will typically be at a much lower pressure than the stabilized liquid begin discharged, e.g., the receiving liquid may be at ambient temperature and pressure.

Further, the second tube has one end which is closed, while the discharge end of the second tube extends further downstream by at least 0.50 inch, and preferrably at least 0.65 inch, in the direction of liquid flow through the nozzle than the second end of the first tube.

Still further, the opening in the side wall of the first tube is disposed at least 0.75 inch from the second end of the first tube, and the openings in the side walls of the first and second tubes have different shapes and/or sizes.

With such discharge nozzle according to the second aspect of the present invention, the pressurized, stabilized, gas-infused liquid can be efficiently discharged into the receiving liquid while minimizing release of any infused gas. There are multiple reasons for such efficient discharge. First, some of the pressurized, stabilized, gas-infused liquid is discharged into the space between the first and second tubes via the opening defined in the sidewall of the first tube, which decreases the velocity and pressure of the liquid stream which continues to flow in the first tube toward the second (discharge) end of the first tube. Second, the discharge of some of the pressurized, stabilized, gas-infused liquid through the opening in the sidewall of the first tube does not cause much or any shear and cavitation of nuclei in the discharged liquid as it is diluted into and mixed with the receiving liquid in the space between the first and second tubes, so that the liquid discharged through the opening in the sidewall of the first tube is efficiently diluted into the receiving liquid.

Third, because the open second end of the second tube extends further downstream by at least 0.25 inch in the direction of liquid flow through the nozzle than the second end of the first tube, discharge of the stabilized, gas-infused liquid through the second end of the first tube, and the portion of the pressurized liquid discharged through the opening in the sidewall of the first tube, creates a vacuum in the space between the first and second tubes. Such vacuum causes a draft of some of the receiving liquid through the opening in the sidewall in the second tube into the space between the first and second tubes, which then flows through the space in and along the same direction as the liquid flow through the nozzle. This draft of the receiving liquid, efficiently mixes with the pressurized liquid being discharged from the second end and the sidewall opening in the first tube such that the discharged gas-infused liquid does not cause much or any shear and cavitation of nuclei in the discharged liquid as it is diluted into and mixed with the receiving liquid being drafted through the space between the tubes. Further, drafting of some of the receiving liquid in and along the space between the two tubes will bring the temperature of the pressurized liquid close to that of the receiving liquid, and whereby there is no substantial temperature change when the pressurized liquid is discharged into an mixes with the receiving liquid. A substantial temperature change may be undesirable in that it may cause the stabilized, gas-infused liquid to rise toward the upper surface of the receiving liquid and/or may cause some of the infused gas to be released from the liquid.

For a more complete understanding of the present invention, the reader is referred to the following detailed description section, which should be read in conjunction with the accompanying drawings showing present embodiments of the invention. Throughout the following detailed description and in the drawings, like numbers refer to like parts.

Intent of Disclosure

Although the following disclosure offered for public dissemination is detailed to ensure adequacy and aid in understanding of the invention, this is not intended to prejudice that purpose of a patent which is to cover each new inventive concept therein no matter how it may later be disguised by variations in form or additions of further improvements. The claims at the end hereof are the chief aid toward this purpose, as it is these that meet the requirement of pointing out the improvements, combinations and methods in which the inventive concepts are found.

There have been chosen specific exemplary embodiments of a system for generating a gas-infused liquid, a flow path arrangement for stabilizing the gas-infused liquid, and a nozzle for efficiently discharging the stabilized, gas-infused liquid into a receiving liquid according to the present invention, as well as some alternative structures and modifications thereto. The exemplary embodiments chosen for the purposes of illustration and description of the structure and method of the invention are shown in the accompanying drawings forming a part of the specification.

DETAILED DESCRIPTION OF PRESENT EXEMPLARY EMBODIMENTS

System for Infusing Gas into Liquid

Figure 1:
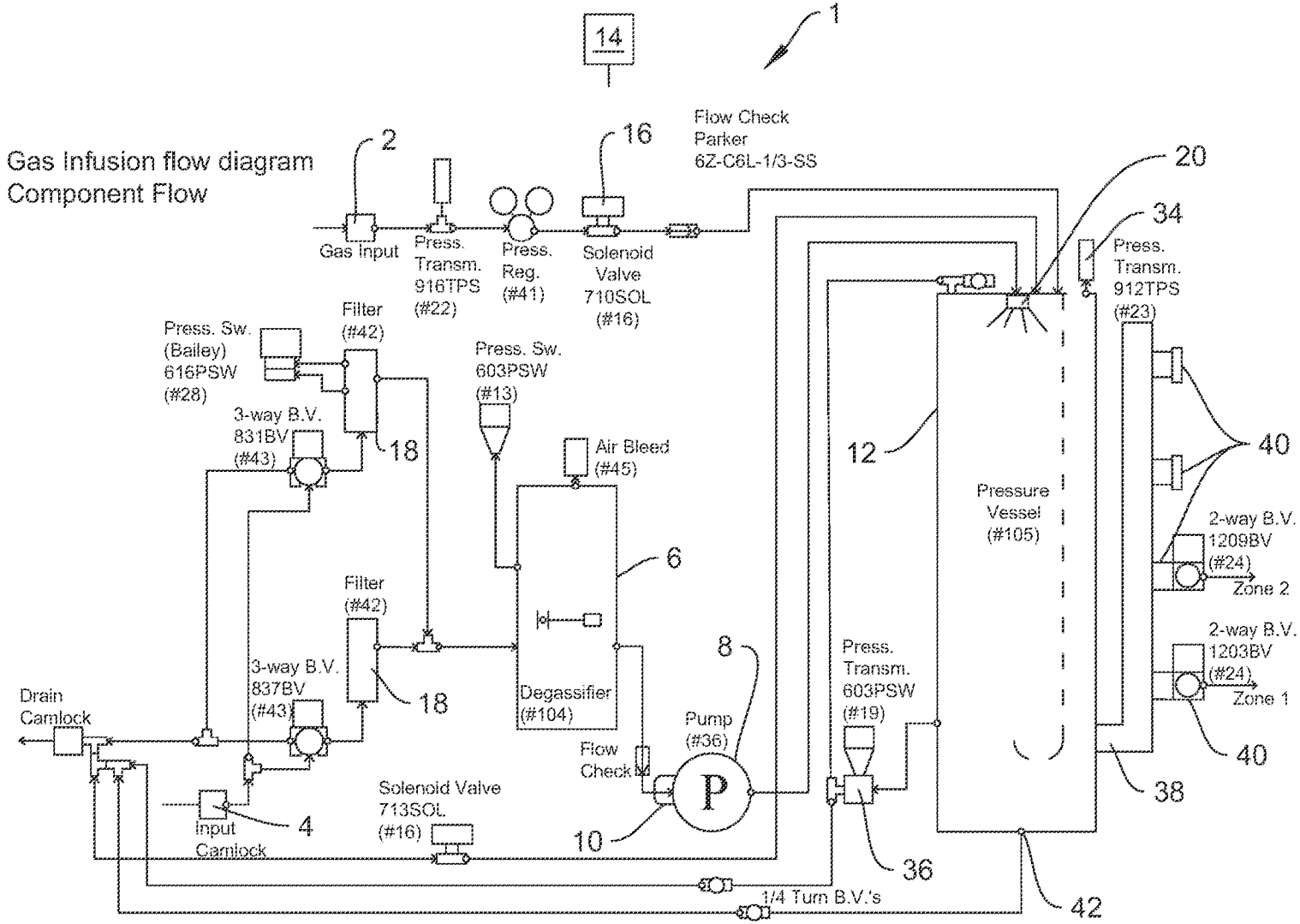
FIG. 1 is a schematic diagram of a system for generating a gas-infused liquid under hyperbaric conditions according to an exemplary embodiment of the present invention.

With reference to FIG. 1 there is shown a schematic diagram of a system 1 for generating a gas-infused liquid under hyperbaric conditions according to an exemplary embodiment of the present invention. The system 1 generally includes a pressurized gas source 2, a source of water or other liquid 4, a degassifier 6, a pump 8 for the liquid, a motor 10 which drives the pump, an enclosed pressure vessel 12 into which the pressurized gas and the liquid are injected for thereby generating a gas-infused fluid, and a controller 14 which controls operation of the system. Gas-infused liquid discharged from the system 1 of FIG. 1 may be directed to flow through a special flow path arrangement, an exemplary embodiment of which is shown at 50 in FIG.

2, to thereby stabilize the infused gas in the liquid, e.g., in the form of nanobubbles, as discussed further below.

The pressurized gas source 2 may comprise any appropriate gas or gasses which are to be infused in the liquid and would be regulated at an appropriate pressure for the desired amount of infusion into the liquid, e.g., 20 to 300 psi. A valve 16 such a solenoid valve may be provided in a gas flow line for controlling flow of the gas or gasses into the pressure vessel 12, which valve is controlled by the controller 14. The gas or gasses may be injected into any appropriate portion of the pressure vessel, such as a top portion above a fluid level in the vessel, a bottom portion below the fluid level in the vessel, or into multiple portions of the vessel.

The liquid source 4 may comprise water or any appropriate liquid which is to be infused with the gas or gasses, e.g., it may be may be a pure liquid or a liquid containing various impurities therein. The liquid may be a liquid which is to be directly treated by reacting with the gas or gasses infused therein or is to be otherwise treated in a process promoted by the gas or gasses infused therein, such as bio remediation of waste water. The liquid may be one that will be subsequently reacted with another substance in a process promoted by the gas or gasses infused therein, such as an oxygen-infused aqueous solution which is to subsequently combined with a liquid hydrocarbon for removing solid matter and/or other impurities from the liquid hydrocarbon. In an exemplary embodiment, the liquid to be gas-infused in the pressure vessel 12 and the flow path arrangement 50 is water and the gas to be infused therein contains oxygen. The water can be distilled water, well water, recovered water, waste water, brine, salt water, or a mixture thereof. The oxygen-containing gas may be air, substantially pure oxygen, or something else. Preferably, the gas includes at least 80%, or at least 90% oxygen. The system 1 may further includes an oxygen concentrator (e.g., a vacuum swing adsorption unit, not shown) and the gas carried in the pressure vessel is the product of the oxygen concentrator.

To any extent that the liquid may contain impurities such as solid matter therein, the system 1 may further include one or more filters such as shown at 18 for removing the impurities. It is normally desirable that the liquid should contain no gas as it is pumped and injected into the pressure vessel 12, e.g., it is in a non-compressible hydraulic state. Correspondingly, the liquid may be passed through the degassifier 6 prior to being pumped.

The pump 8 may be any appropriate pump for a given application, including the type of liquid, whether the liquid contains suspended solids or other solid matter, rate of liquid to be pumped, pressure(s) at which the liquid is to be pumped, etc. For many applications a variable pressure, triplex, positive displacement pump would be suitable. The motor 10 which drives the pump 8 is controlled by the controller 14 according to an appropriate algorithm and/or program stored in a memory of the controller, as discussed further below.

After the liquid passes through the pump 8 it is then injected into the pressure vessel 12. This may involve one or more injection nozzles 20, which may be disposed at the top of the pressure vessel 12 to inject the liquid as an atomized spray downwardly into the vessel. After the droplets of the liquid are injected into the top of the vessel, the droplets move downwardly and becomes infused with the gas. For this purpose, the liquid injection nozzle(s) 20 may be configured to generate a large cone angle spray pattern of fine droplets of the liquid as it is injected into the vessel 12. Typically, the gas-infused liquid will fill the vessel about half way during a gas-infusion operation in which the gas(es) and liquid are injected into the vessel while the gas-infused liquid is discharged from the vessel at a lower portion thereof. The upper portion of the vessel is filled with the pressurized gas that has been injected therein.

The injection nozzle(s) 20 may have any appropriate construction for atomizing a liquid which is being injected under pressure into the vessel 12. For example, the injection nozzle may have a structure according to the present inventor's previously proposed design as set forth in U.S. Pat. No. 9,527,046 B2, the disclosure of which is incorporated herein by reference. As explained in U.S. Pat. No. 9,527,046 B2, such previously proposed nozzle design, the amount of liquid being injected into the pressure vessel through the nozzle increases with increasing fluid pressure, and the injection nozzle is essentially self-cleaning so that it may be effectively used to discharge pure liquids, as well as liquids having solid matter therein.

Figure 2:
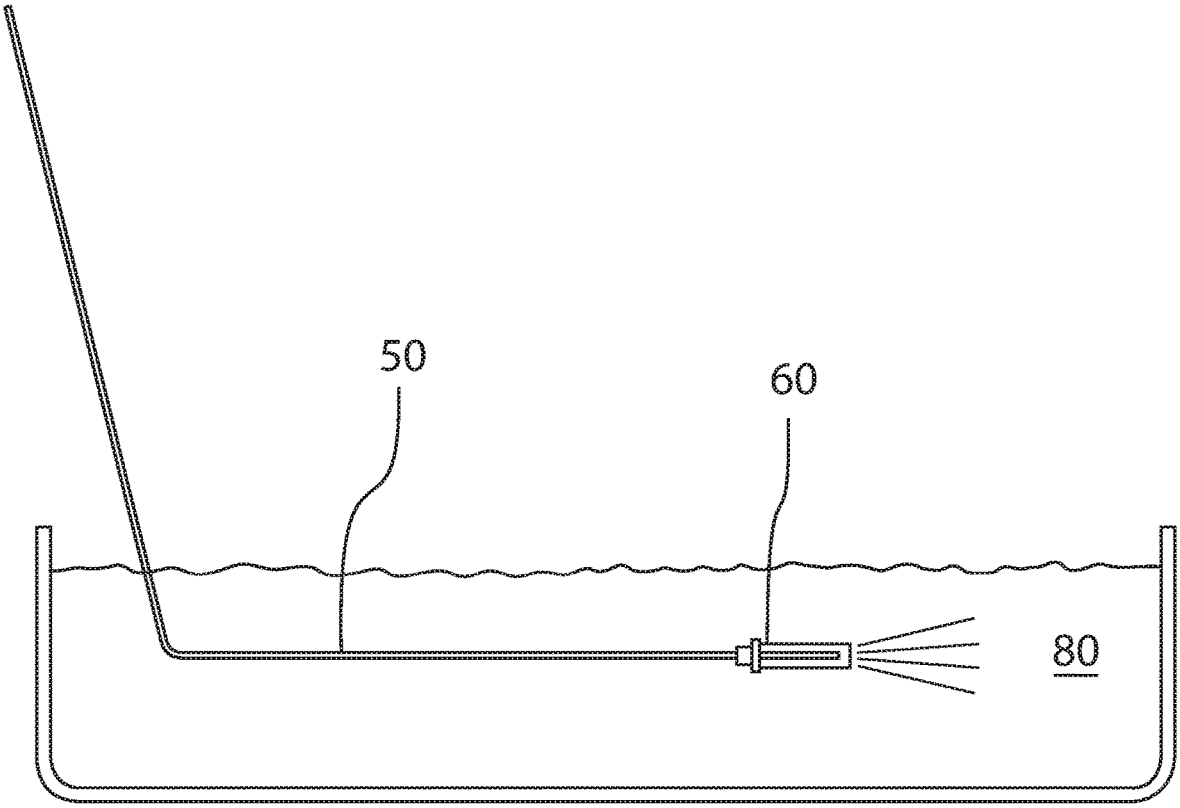
FIG. 2 is a schematic diagram showing a stabilizing flow path and a nozzle for discharging a pressurized, stabilized, gas-infused liquid into a receiving liquid while minimizing release of any infused gas according to an exemplary embodiment of the present invention.

Systems for Stabilizing the Gas-Infused Liquid and for Discharging Same into Receiving Liquid With reference to FIG. 2, there is shown, a schematic diagram of a stabilizing flow path 50 for stabilizing a pressurized, gas-infused liquid and a nozzle 60 for discharging the pressurized, stabilized, gas-infused liquid into a receiving liquid 80 while minimizing release of any infused gas according to an exemplary embodiment of the present invention. The stabilizing flow path 50 may, for example, be connected to a discharge outlet 40 of the pressure vessel 12 in the system of FIG. 1 via a length of tubing (not shown). The gas-infused liquid being discharged from the pressure vessel should be maintained at substantially the same pressure in the connecting tubing and in the flow path 50 as in the pressure vessel 12. The connecting tubing may be made of any appropriate material that will not chemically or thermally react with the gas-infused liquid, e.g., crosslinked poyethylene.

System for Stabilizing the Gas-Infused Liquid

The stabilizing flow path for stabilizing gas-infused liquid 50 according to the exemplary embodiment may comprise a length of tubing which is at least 100 times as long as a mean inner diameter thereof, preferrably the flow path 50 is at least 200 times as long as a mean inner diameter thereof, and more preferrably at least 223 times as long as a mean inner diameter thereof, wherein an inner surface of the flow path configured to engage the gas-infused liquid flowing through the flow path is formed of material having a surface roughness (Ra) in a range of 0.1 μm-10.0 μm. The tubing forming the flow path 50 is preferrably circular in cross section although it may be of other shapes defined by a smooth curve such as oval. As discussed further herein, a rolling action is generated in the gas-infused liquids passing through the flow path, moving the flowing gas-infused liquid from the outer portion of the flow path in engagement with the tubing walls toward the center portion of the flow path, and the infused gas is compressed into smaller size bubbles as the liquid flows in the center portion of the liquid stream. The smooth curved inner circumferential surface of the tubing promotes the rolling action, and also promotes a more uniform compression of gas into bubbles in the center portion of the flowing liquid stream. While the tubing forming the flow path could have a polygonal cross section, such as square, this would not work as effectively as tubing having a smooth curved inner circumferential surface for stabilizing gas-infused liquids.

The surface roughness of the material forming the inner surfaces of the flow path is important. The roughness should be large enough to cause sufficient friction between the outer portion of the flowing liquid when it engages the inner surfaces of the tubing so as to break up the gas bubbles in the outer portion of the liquid stream, but not so large as to destabilize the flow of the entire liquid stream, so that the gas can be compressed into smaller and smaller size bubbles as it flows further and further along the flow path. Of course, the specific liquid(s) and the gas(es) infused therein will have some bearing on the amount of friction being generated by engagement of the gas-infused liquid as it engages with the inner surfaces of the tubing as the gas-infused liquid flows through the flow path 50. However, the surface roughness of the inner surfaces of the tubing is a much more significant factor, and when water is the liquid the present inventor has found that tubing formed of metals such as stainless steel with various finishes such as satin polish, bead blasted and electropolished, are appropriate for use in constructing the flow path 50 because these materials have a surface roughness in a range of 0.1 μm-10.0 μm, which causes an appropriate amount of friction with the flowing water. Additionally, materials such as stainless steel are relatively resistant to chemically reacting with many liquids, which is desirable. If the material forming the inner surfaces of the flow path has a surface roughness Ra of less than 0.1 μm, e.g., materials such as silica based glass or plastics, the material will not be sufficiently rough to break up bubbles of gas infused in the liquid stream flowing through the flow path, which is a necessary part of the stabilization process as discussed further herein. On the other hand, if the material forming the inner surfaces of the flow path has a surface roughness Ra of more that 10.0 μm, e.g., materials such as carbon steel, galvanized steel, cast iron, and concrete, the material will be excessively rough and causes too much turbulence in the entire liquid stream as it flows along the flow path, it will not be effective for forming the infused gas into very small, stable bubbles as discussed further herein. Generally, as the surface roughness of the material forming the inner surfaces of the flow path increases within the range of 0.1 μm-10.0 μm the stabilized bubbles of gas within the liquid which has completely flowed through the flow path will have a larger size.

The flow path 50 may be substantially linear or may be curved and may include one or more radial bends therein. Again, however, the flow of liquid through the flow path should be substantially smooth and consistent without a large amount of turbulence in order to achieve an efficient stabilizing effect. The mean inner diameter of the flow path 50 is not particularly important to the present invention. Through experimentation the present inventor has determined that flow paths having a mean inner diameter in a range of 0.10 inch to 8 inches (2.5 to 203 mm) are effective, and it is expected that flow paths with even larger mean inner diameters would also function to effectively stabilize a gas-infused liquid according to the present invention.

Through investigation, the present inventor has determined that when a pressurized gas-infused liquid passes through the flow path 50 having the discussed characteristics, and under a pressure of at least 20 psi, the gas which was previously infused in the liquid, e.g., in pressure vessel 12, becomes stabilized by being compressed into much smaller size bubbles, which are inherently more stable than larger or coarse size bubbles. The pressure may be any pressure of 20 psi or greater, although the higher the pressure the greater the amount of gas that may be infused into a liquid. The pressure at which the gas is infused into the liquid in the pressure tank 12 will typically be the same pressure under which the gas-infused liquid flows through the flow path 50, noting that if there were to be a pressure change between when the gas-infused liquid is discharged from the pressure vessel 12 and the when the gas-infused liquid flows through the flow path 50 this may undesirably cause shear and/or cavitation in the liquid.

With such flow path 50 according to the exemplary embodiment of the present invention, as a stream of the pressurized, gas-infused liquid passes through the flow path, a central portion of the liquid stream flows at a higher rate and a more uniform manner than an outer portion of the stream which engages surfaces of the flow path. These differences cause bubbles of gas which have been infused into the liquid to become smaller and smaller, and correspondingly more and more stably infused in the liquid, as the liquid stream flows along the length of the flow path.

Although the exact process whereby the gas bubbles are reduced in size, to become more stably infused in the liquid, as the pressurized liquid passes through the flow path may not be fully understood, it is believed that the outer portion of the liquid stream is agitated through engagement with the surfaces of the flow path, which breaks up the gas bubbles in the outer portion of the liquid stream, and which also causes the outer portion of the liquid stream also roll toward and mix into the center portion of the liquid stream. Further, it is believed that while flowing along in the center portion of the liquid stream the gas from the bubbles which have been broken up is compressed into new, smaller size bubbles. These actions are repeated as the liquid stream continues to flow along the flow path, causing the infused gas in the liquid to be compressed into smaller and smaller size bubbles as the liquid stream flows along the flow path 50. Generally, by forming the surfaces of the flow path configured to engage the gas-infused liquid of material having a surface roughness (Ra) in a range of 0.1 μm-10.0 μm, and making the flow path at least at least 100 times as long as a mean inner diameter thereof, this assures that the gas bubbles will be reduced to a sufficiently small size on the order of nanometers when they are passed completely through the flow path under a pressure of at least 20 psi. The stabilized, infused gas will stably remain in the liquid for at least a few weeks even if the liquid is brought up to ambient temperature and pressure. It is important for purposes of stabilization that the center portion of the stream of gas-infused liquid flowing through the flow path 50 should flow in a relatively stable or laminar condition so that the infused gas may be compressed into smaller size bubbles in the center portion of the liquid stream as it flows along the flow path. If the center portion of the liquid stream is flowing in a highly agitated or turbulent state, it will not efficiently compress the gas into smaller size bubbles. Hence, the surface roughness of the inner surfaces of the flow path should not exceed 10.0 μm, and there should not be any significant obstacles or constrictions projecting into the flow path.

In terms of length of the flow path 50, the specific length which is most appropriate and efficient for stabilizing the pressurized, gas-infused liquid will vary depending on the specific liquid(s) and the gas(es) infused therein, as well as on the surface roughness Ra of the inner surfaces of the flow path which engage with the flowing liquid and the amount of stabilization desired, noting that for some applications alrger, less stable gas bubbles may be desired. However, for water infused with a gas such as oxygen flowing through a flow path made of 316 stainless steel tubing with a mean inner diameter in a range of 0.10 inch to 8 inches (2.5 to 203 mm), the present inventor has found that the flow path should be at least 100 times the inner diameter of the flow path, preferrably the flow path 50 is at least 200 times as long as a mean inner diameter thereof, and more preferrably at least 223 times as long as a mean inner diameter thereof. For most applications, any flow path length exceeding 1000 times the mean inner diameter will not increase the degree to which the gas-infused liquid is stabilized to any appreciable extent.

In terms of pressure under which the gas-infused liquid flows through the flow path 50, the present inventor has determined that the pressure should be at least 20 psi up to any desired pressure such as 1000 psi or higher, although as a practical matter and in light of safety and cost considerations, a pressure in an upper limit range of 300 to 1000 psi may be sufficient for most applications. Also, the present inventor has determined that generally the higher the pressure the greater the amount of gas that may be stably infused in a liquid. A higher pressure in the pressure vessel 12 permits a higher amount of gas to be initially infused in the liquid, and flowing the gas-infused liquid under a correspondingly higher pressure through the flow path 50 permits the larger amount of infused gas in the liquid to be stabilized.

As will be understood from the above discussion, there are several factors which affect the ability of the flow path 50 to efficiently stabilize the gas-infused liquid flowing therethrough, including the particular liquid(s), the particular gas(es), the surface roughness of the internal surfaces of the flow path, the length of the flow path, and the pressure under which the gas-infused liquid is maintained as it flows through the flow path. Some of these factors may be fixed for any given application such as the gas(s) and liquid(s) being used and the desired amount of gas(ses) to be infused into the liquid(s), but it is possible to alter some of the other factors, including the length of the flow path 50, treating or modifying the surface of materials forming the inner surface of the flow path so as to increase or reduce the surface roughness Ra thereof, and the pressure under which the gas-infused liquid flows through the flow path in order to achieve a desired result.

In terms of altering a surface roughness of the inner surfaces of the flow path, this may be done uniformly along the entire flow path or some portions thereof, but should not restrict any portion of the flow path excessively, as this may create a type of venturi effect as the liquid stream passes from a restricted portion to non-restricted or less restricted portion, and this may cause cavitation in the liquid stream.

The stabilizing devices disclosed in U.S. Pat. Nos. 9,527,046 B2 and 9,586,186 B2, as previously proposed by the present inventor, involve flowing the gas-infused liquids through tubular flow paths having a series of alternating straight and curved sections such that coarse gas bubbles in the liquids are efficiently broken up when flowing through the curved sections and compressed into very small, e.g., nano size, bubbles when flowing through the straight sections. The stabilizing flow path 50 according to the exemplary embodiment of the present invention accomplishes a similar result, but in a less complex manner, again, noting that the flow path 50 may be linear or curved. Of course, it is possible to combine aspects of the previously proposed devices together with the flow path 50 of the present embodiment if desired, e.g., adding some alternating straight and curved sections in the flow path 50 and reducing the overall length of the flow path 50, while still achieving the desired stabilization effect.

Although not shown, it is also possible to control the temperature of the gas-infused liquid flowing through the flow path 50, e.g., by providing a heat exchanging jacket or other device in surrounding reaction to the flow path, and flowing some type of temperature-regulated medium through the jacket that would effect heat exchange with the gas-infused liquid flowing through the flow path 50.

System for Discharging Stabilized, Gas-Infused Liquid into Receiving Liquid

With reference to FIGS. 2-5, there is shown an exemplary embodiment of a system for efficiently discharging a stabilized, gas-infused liquid which has passed through the flow path 50 into a receiving liquid, e.g., for purposes of treating the receiving liquid using the gas-infused liquid. Again, the system includes the discharge nozzle 60 which would be at least partially submerged into a body of the receiving liquid 80 such that the stabilized, gas-infused liquid is discharged from the nozzle into the receiving liquid in a manner which causes little or no cavitation or shear so as to minimize release of any infused gas via the discharging process itself. The receiving liquid will typically be at a much lower pressure than the stabilized liquid being discharged, e.g., the receiving liquid may be at an ambient pressure of 13-18 psi (90-120 kPa), whereas the gas-infused liquid is at least 20 psi and perhaps much higher. The receiving liquid will typically also be at a temperature of 0-25° C. Generally, the higher the temperature of the receiving liquid into which the stabilized, gas-infused liquid is discharged, the shorter the period in which the gas will remain in the combined liquids.

As depicted, the nozzle 60 may include: a first tube 62 having a first end that would receive the pressurized stream of stabilized, gas-infused liquid after it passes through the stabilizing flow path 50 and a second or opposite end from which the pressurized stream of stabilized, gas-infused liquid is discharged; a fluid-tight coupling 64 that fluid-tightly connects the first end of the first tube 62 to a source of stabilized, gas-infused liquid, such as a discharge end of the flow path 50; and a second, larger tube 66 which is fixed in surrounding relation to at least a portion of the first tube with a space therebetween, and which includes an open discharge end that extends further downstream in a direction of liquid flow through the nozzle than the second end of the first tube. Further, the first tube has an opening 68 defined in a sidewall thereof, the second tube has an opening 70 defined in a sidewall thereof, and the opening 68 in the side wall of the first tube is disposed further downstream in the direction of liquid flow through the nozzle than the opening 70 in the sidewall of the second tube. In use such discharge nozzle 60 according to the present invention would be at least partially submerged in the receiving liquid 80, including the second or discharge end of the first tube, the discharge end of the second tube and portions of the first and second tubes having the openings 68, 70 defined in the side walls thereof, such that the receiving liquid fills the space between the submerged portions of the first and second tubes. An inner diameter of the first tube 62 should be the same or substantially the same as that of a discharge end of the flow path 50 so that little or no shear, cavitation or turbulence is caused in the stabilized, gas-infused liquid as it passes from the flow path into the first tube.

The first tube 62 may generally be made of any desired material, noting that that the gas-infused liquid has already been stabilized prior to entering the discharge nozzle 60, and that the primary function of the nozzle is to efficiently discharge a stabilized, gas-infused liquid into a receiving liquid in a manner that does not cause much or any of the infused gas to be released via the discharging. However, the tube 62 should not be made of a material that would be detrimentally affected by the pressurized, gas-infused liquid being discharged therethrough, e.g., chemically, thermally, or mechanically. Thus, the first tube may be made of metal such as stainless steel or plastic. However, for some applications, e.g., where the receiving liquid is at a temperature which is different from that of the gas-infused liquid being discharged, it would be desirable if the first tube is made of a material which is thermally conductive (not thermally insulative) so that heat exchange may efficiently occur between the gas-infused liquid stream flowing in the first tube and the receiving liquid in the space between the first and second tubes, and whereby the temperature of the gas-infused liquid may be brought closer to that of the receiving liquid by the time it is discharged into the receiving liquid. If the gas-infused liquid being discharged from the nozzle is at a significantly higher temperature than the receiving liquid, e.g., 10° F. or more, the gas-infused liquid will tend to rise within the receiving liquid. This may be undesirable. e.g., if one is seeking to treat the entire body of receiving liquid or a lower portion of the receiving liquid body.

The cross sectional shape of the first tube 62 is not particularly important, although it should not be a shape that would cause any significant amount of shear, cavitation or turbulence in the gas-infused liquid as it flows through the first tube and is discharged through the opening 68 and the discharge end of the tube. Similar to the flow path 50, the cross section of the tube 62 may be circular or other shapes defined by a smooth curve such as oval. While the tubing forming the tube 62 could have a polygonal cross section, such as square, this would not work as effectively as a tube having a smooth curved inner circumferential surface, particularly at the opening 68 and discharge end of the tube 62. The first tube 62 may be linear or curved somewhat, as long as no substantial turbulence is generated in the gas-infused liquid flowing through the first tube.

The overall length of the first tube is not particularly important. As discussed herein, however, the opening 68 in the sidewall of the first tube should be disposed at a location sufficiently spaced from the second-discharge end of the tube, and the tube 62 should have sufficient length for any necessary heat exchange to occur between the gas-infused liquid flowing therethrough and the receiving liquid in the space between the first and second tubes. Generally, the first tube may be at least five (5) inches or 12.5 cm long, and suitable length may increase with the inner diameter of the tube.

The location of the opening 68 in the sidewall of the first tube 62, as well as the size, orientation and shape of the opening are important aspects of the discharge nozzle, e.g., for purposes of efficiently discharging the stabilized gas-infused liquid in a manner that causes little or no gas to be released via the discharging process. The opening 68 is constructed to permit some, e.g., 20%-35%, of the pressurized, stabilized, gas-infused liquid stream flowing through the tube 62 to be discharged into the space between the first and second tubes 62, 66 via the opening, which decreases the velocity and pressure of the liquid stream which continues to flow in the first tube toward the second (discharge) end of the first tube, and also contributes to generation of a draft of the receiving liquid through the opening 70 in the second tube and along the space between the two tubes, so that the gas-infused liquid discharged through the opening 68 and through the discharge end of the first tube efficiently mixes with the receiving liquid while causing little or no discharge of the infused gas.

An optimal position of the opening 68 in the sidewall of the tube 62 will vary somewhat depending on the inner diameter of the tube, but may generally be spaced away from the discharge end of the tube 62 by a distance in a range of 3-18 times the inner diameter of the tube, and preferrably by a distance in a range of 4.5-14.5 times the inner diameter of the tube. For example, if the first tube has an inner diameter of ¼ inch (0.635 cm), the opening 68 should be disposed at least ¾ inch (1.9 cm) from the discharge end of the tube 62, whereas if the tube has an inner diameter of 2.0 inches (5.1 cm), the opening 68 should be disposed at least 6 inches (15.24 cm) from the discharge end of the tube 62. The opening 68 should be positioned sufficiently away from the discharge end of the tube that the gas-infused liquid discharged through the opening should be fully and smoothly intermixed with the draft of receiving liquid flowing along the space between the first and second tubes by the time the mixture of the two liquids reaches the discharge end of the first tube.

An optimal size of the discharge opening 68 is in a range of 20-35% of the cross sectional area of the inner circumference of the first tube 62, and preferrably 22-30% of the cross sectional area of the inner circumference of the first tube 62. Again, this is important so that the gas-infused liquid discharged through the opening will be fully and smoothly intermixed with the draft of receiving liquid flowing along the space between the first and second tubes by the time the mixture of the two liquids reaches the discharge end of the first tube. If the size of the opening is less than 20% of the cross sectional area of the inner circumference of the first tube it will not permit a sufficient amount of the gas-infused liquid to be discharged therethrough to properly reduce the velocity and pressure of the liquid stream continuing to flow toward the discharge end of the tube, and will not sufficiently help to achieve a proper draft of the receiving liquid flowing in the space between the two tubes. On the other hand, if the size of the opening is more than 35% of the cross sectional area of the inner circumference of the first tube it may permit discharge an excessive amount of the gas-infused liquid through the opening, which may result in generation of shear, cavitation and turbulence in the discharged liquid, and will also interfere with generation of a proper draft of the receiving liquid in the space between the tubes.

Figure 5:
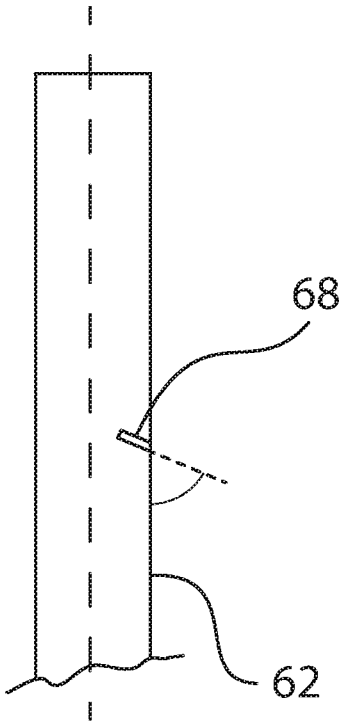
FIG. 5 is an enlarged, side elevational view of an inner tubular portion of the discharge nozzle in FIG. 2.

The specific shape and orientation of the opening 68 are not particularly important, however, these are important characteristics to the extent that they should cause little or no shear, cavitation or turbulence in the gas-infused liquid as it is discharged through the opening. Shapewise, the opening may extend as a substantially arcuate cut into the tube 62 such as shown in FIG. 5. With such a shape, however, it is important that the arcuate cut be oriented at an acute angle to the longitudinal axis of the tube 62 such that the cut extends closer to the discharge end of tube the further into the tube the cut extends. An acute angle $\alpha$ of 55-75° to the tube's longitudinal axis is appropriate for such purposes, while the opening 68 shown in FIG. 5 extends at an angle of approximately 67.5 to the longitudinal axis of the tube 62. Such orientation is helpful to prevent shear in the liquid being discharged through the opening. If the arcuate opening 68 was oriented perpendicular to the tube's longitudinal axis, for example, this would cause a significant amount of shear in the liquid being discharged through the opening. As other examples, the opening 68 may be shaped as an elongate slot similar to but smaller than the depicted opening 70 in the second tube 66, or as an oval opening or circular opening. Still further, the tube 62 may also include a plurality of the openings 68, provided that their combined area is in a range of 20-35% of the cross sectional area of the inner circumference of the first tube 62, and that they are spaced circumferentially from each other around the tube 62 rather than along the length of the tube. If multiple opening were provided in spaced manner along the length of the tube 62, this may cause an excessive pressure drop in the fluid stream continuing to flow in the tube, which may undesirably cause shear in the liquid stream.

Further, it is important that when forming the opening 68 in the sidewall of the first tube 62 that the opening should be formed cleanly without any burrs or the like, and without deforming the tube's sidewall surface inward or outward. Any such burrs or deformation would tend to cause turbulence, shear and/or cavitation in the liquid being discharged through the opening, as well as in the liquid stream continuing to flow in the tube.

The second tube 66 primarily functions to surround at least a portion of the first tube 62, including the first tube's discharge end and the opening 68, so as to define the space between the two tubes, such that a draft of the receiving fluid may be created through the opening 70 in the sidewall of the second tube and along the space between the tubes, and such that the draft of receiving liquid flows in a laminar or substantially laminar manner. As depicted, the second tube may have: one end which is closed and connected to the coupling 64 and/or to a portion of the first tube 62 extending from the coupling 64; a second end which is open and which extends further downstream by at least 0.50 inch, and preferrably at least 0.65 inch, in the direction of liquid flow through the nozzle than the discharge end of the first tube; and the opening 70 defined through a sidewall thereof in the vicinity of the closed first end.

In this regard, it is important for purposes of minimizing any shear, turbulence or cavitation in the gas-infused liquid being discharged from the nozzle 60 that the draft of the receiving fluid flowing through the opening 70 and along the space between the tubes should flow in a laminar or substantially laminar manner. In the depicted embodiment, the laminar or substantially laminar is achieved by a combination of factors, including closing the one end of the second tube, extending the discharge end of the second tube further downstream than the discharge end of the first tube in the direction of fluid discharge, the volume of the cross sectional area of the space between the two tubes 62, 66, and providing the opening 70 in an appropriate size, shape and location. By closing the one end of the second tube, e.g., such that no receiving liquid enters into the space between the two tubes via the one end of the second tube, this assures that the receiving liquid being drafted to flow through the space enters the space via the opening 70. If the one end of the second tube 66 is not closed, it may not be possible to consistently create an appropriate draft of the receiving liquid in the space.

By extending the open second end of the second tube further downstream by at least 0.50 inch, and preferrably at least 0.65 inch, in the direction of liquid flow through the nozzle than the discharge end of the first tube, this not only minimizes any shear, turbulence or cavitation in the gas-infused liquid as it is discharged from the discharge of the first tube 62, but also creates a small vacuum in the space between the two tubes, which causes the receiving liquid to be drawn through the opening 70 into and along the space in a laminar flow. The optimum distance by which the open second end of the second tube should extend further downstream than the discharge end of the first tube will also increase as the inner diameter of the first tube increases.

Regarding the opening 70, this must be disposed upstream of the opening 68 of the first tube in the direction of liquid discharge through the nozzle, but the distance between the two openings is not particularly important as long as it is appropriate for achieving sufficient heat exchange between the receiving liquid being drafted through the space between the two tubes and the gas-infused liquid in the first tube. For example, the distance between the two openings may be at least 4-5 times the inner diameter of the first tube. In terms of size, the opening 70 may be larger than that the opening 68, and may have an area in a range of 60%-110% of the cross-sectional area of the inner circumference of the second tube 70, and preferably in a range of 90%-105% of the cross-sectional area of the inner circumference of the second tube 70. By having the combined areas of the openings 68, 70 fall in such range this also helps to assure that small vacuum is created in the space between the two tubes 62, 66 so that the receiving liquid will be drafted through the opening 70 and along the space in a laminar or substantially laminar flow. Further, second tube 66 may have a plurality of the openings 70 defined through the sidewall thereof, which openings 70 are spaced from each other around the circumference of the second tube, again, provided that the collective area of the openings is in the ranges discussed above relative to the cross-sectional area of the inner circumference of the second tube 70. Having plural openings 70 spaced from each other around the circumference of the second tube achieves a more uniform draft flow of the receiving liquid in the space between the two tubes 62, 66. In the exemplary embodiment shown in FIGS. 3-4, the second tube 66 is provided with a pair of the elongate openings 70, 70 disposed directly opposite to, or spaced 180° from, each other on the tube 66.

In terms or orientation, the opening(s) 70 in the second tube 66 may face in the same direction as the direction as the opening 68 in the first tube 62 when the tubes are connected together. However, the opening(s) 70 may face in different direction(s) than the opening 68 in the assembled nozzle 60. Also, there may be more than one of each of the openings 68, 70, and there may be a different number of the opening(s) 70 than that of the opening (68), e.g., there may be one opening 68 and multiple openings 70 or vice versa. Further, the first tube 62 may extend concentrically within the second tube 70, but this is not required. Again, if there are more than one of the openings 70 is provided in the second tube 66, this helps to achieve a more uniform draft of the receiving liquid in the space between the two tubes, regardless of the number, size, shape and orientation of the opening(s) 68 in the first tube.

The particular shape of the opening(s) 70 is not particularly important, again noting that the receiving liquid should flow through the opening 70 in a laminar or substantially laminar manner such that the opening is not likely to cause any turbulence in the receiving liquid flowing therethrough as long as there are no burrs or other restrictions extending into the opening. Some appropriate exemplary shapes include, an elongate, narrow slot such as the exemplary openings depicted in FIGS. 3, 4, an oval opening and a circular opening.

The second tube 70 may generally be made of any desired material, but should not be made of a material that would be detrimentally affected by the receiving liquid in which it is disposed or by the pressurized, gas-infused liquid being discharged into the space between the first and second tubes. For example, the second tube 66 may be made of metal such as stainless steel or plastic. Further, the cross sectional shape of the second tube is not critical, as long as it would not detrimentally interfere with or otherwise affect the draft of receiving liquid flowing between the first and second tubes, or tend to cause any turbulence, shear or cavitation in the gas-infused liquid being discharged through the opening 68 and the discharge end of the first tube.

With such discharge nozzle according to the second aspect of the present invention, the pressurized, stabilized, gas-infused liquid can be efficiently discharged into the receiving liquid while minimizing release of any infused gas for multiple reasons. First, some of the pressurized, stabilized, gas-infused liquid is discharged into the space between the first and second tubes via the opening 68 defined in the sidewall of the first tube, which decreases the velocity and pressure of the liquid stream which continues to flow in the first tube toward the second (discharge) end of the first tube. Second, the discharge of some of the pressurized, stabilized, gas-infused liquid through the opening in the sidewall of the first tube does not cause much or any shear and cavitation of nuclei in the discharged liquid as it is diluted into and mixed with the receiving liquid in the space between the first and second tubes, so that the liquid discharged through the opening in the sidewall of the first tube is efficiently diluted into the receiving liquid.

Third, because the open second end of the second tube extends further downstream by at least 0.25 inch in the direction of liquid flow through the nozzle than the second end of the first tube, discharge of the stabilized, gas-infused liquid through the second end of the first tube, and to a lesser extent the portion of the pressurized liquid discharged through the opening in the sidewall of the first tube, creates a draft of some of the receiving liquid through the opening 70 in the sidewall in the second tube into the space between the first and second tubes, in and along the same direction as the liquid flow through the nozzle. This draft of the receiving liquid, efficiently mixes with the pressurized liquid being discharged from the second end and the sidewall opening in the first tube such that the discharge does not cause much or any shear and cavitation of nuclei in the discharged liquid as it is diluted into and mixed with the receiving liquid being drafted through the opening in the sidewall of the second tube and the space between the tubes. Further, drafting of some of the receiving liquid in and along the space between the two tubes will bring the temperature of the pressurized liquid close to that of the receiving liquid, and whereby there is no substantial temperature change when the pressurized liquid is discharged into an mixes with the receiving liquid. A substantial temperature change may be undesirable in that it may cause the stabilized, gas-infused liquid to rise toward the upper surface of the receiving liquid and/or may cause some of the infused gas to be released from the liquid.

Example of the Discharge Nozzle

Figure 3:
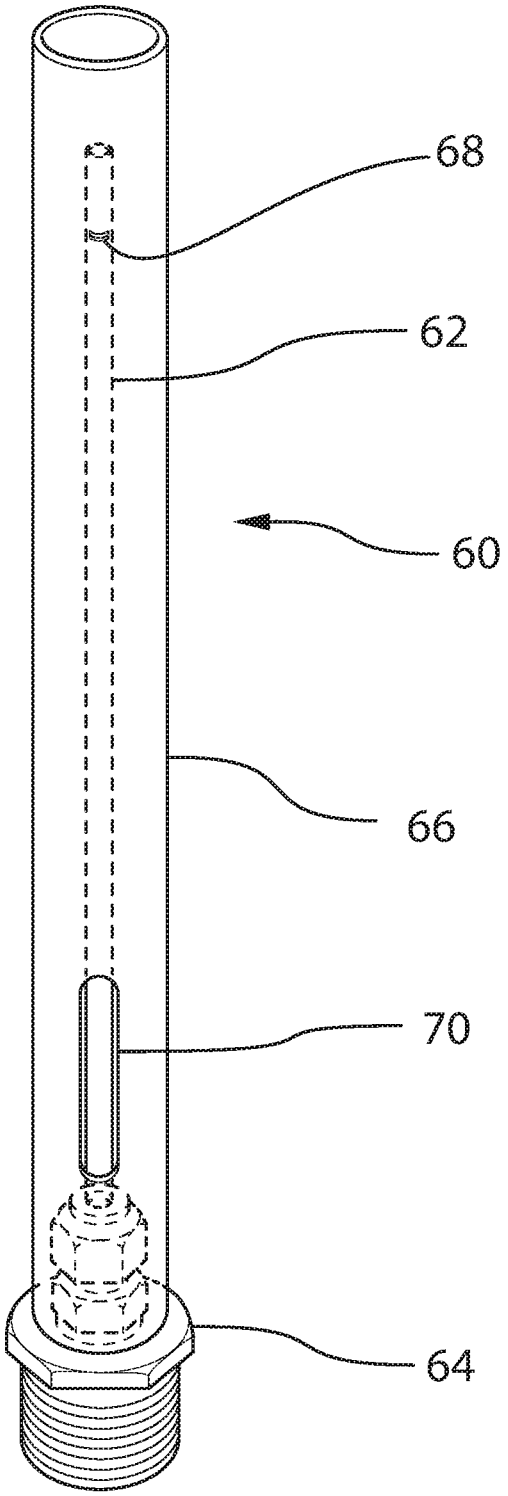
FIG. 3 is an enlarged perspective view of the discharge nozzle in FIG. 2.
Figure 4:
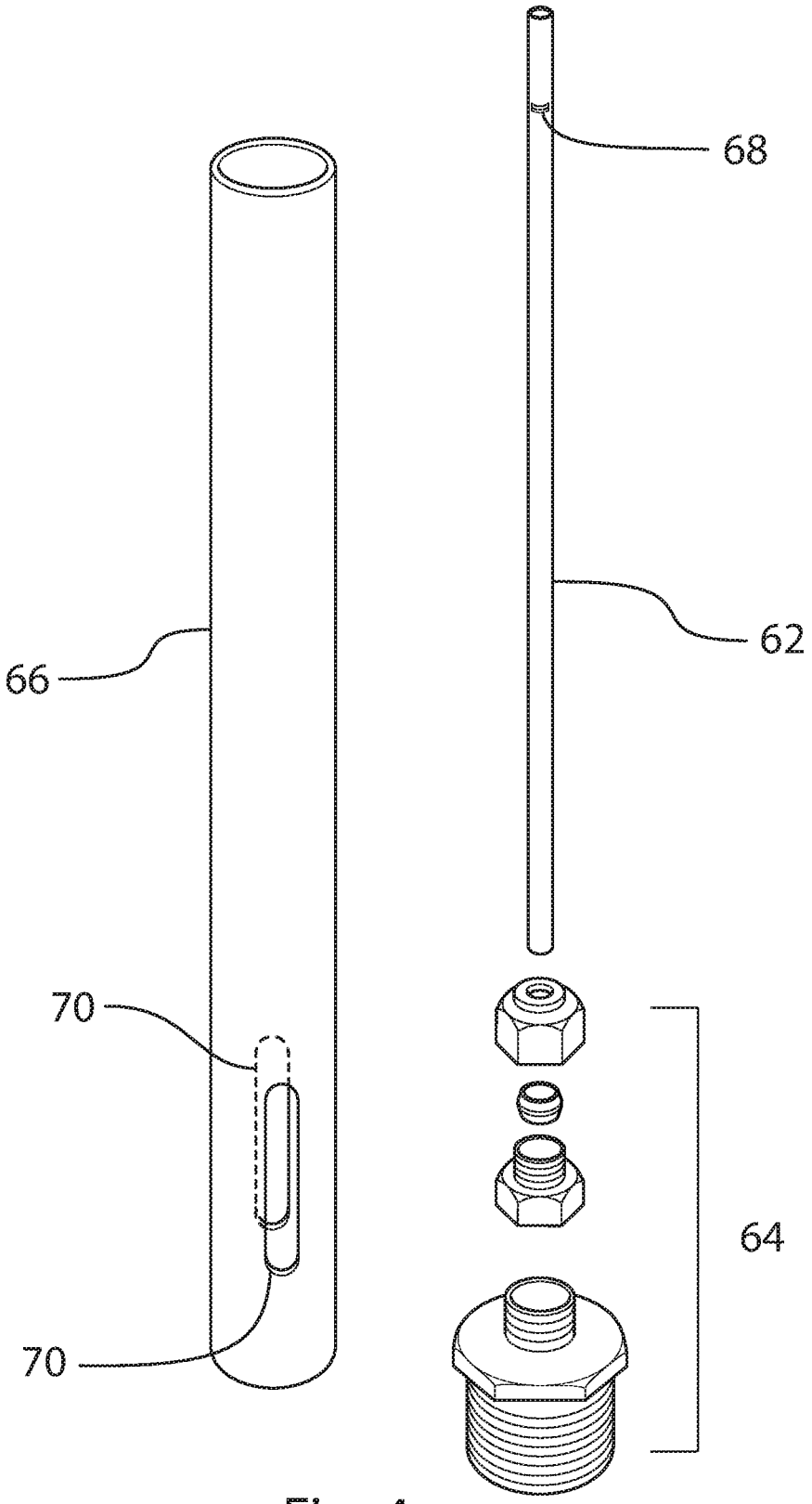
FIG. 4 is an enlarged and exploded perspective view of the discharge nozzle in FIG. 2.

According to one specific example of the discharge nozzle 60 according to the present invention and with the general features of the exemplary embodiment shown in FIGS. 3-5, the first and second tubes 62, 66 and the coupling 64 were formed of mill finish stainless steel, the first tube had an outer diameter of ¼ inch (wall thickness 0.063 inch), the second tube 66 had an outer diameter of 1.0 inch (wall thickness 0.063 inch), and the discharge end of the second tube extended 0.75 inch further downstream than the discharge end of the first tube in the direction of flow of the gas-infused liquid through the nozzle. Further, the opening 68 had a width of 0.025 inch and extended into the tube 62 at an angle of 67° and an area which was approximately 25% as the inner cross sectional area of the tube 62, while the second tube 66 included a pair of the openings 70, 70 disposed directly opposite to, or spaced 180° from, each other on the tube 66, each of the openings 70 was an elongate slot approximately 1.125 inch long and 0.3 inch wide so that the combined areas of the two openings 70, 70 was approximately the same as the area as the inner cross sectional area of the second tube 66. The nozzle 60 was fully submerged a receiving body of water which was at ambient temperature and pressure, and when the nozzle was used to discharge water stably infused with oxygen under various pressures of 20-1000 psi into the receiving body of water, essentially none of the infused gas was released via the discharging process. Based on measurements involving laser light transmitted through the resulting mixture of the stabilized, oxygen-infused water and the receiving water, the infused oxygen was ion the form of nanobubbles having a size of approximately 1 nm-50 nm.

The foregoing description is given for clearness of understanding only, and no unnecessary limitations should be understood therefrom, as modifications within the scope of the invention may be apparent to those having ordinary skill in the art.

What is claimed:

1. A system for stabilizing gas-infused liquid, comprising:

a tubular flow path configured to receive and pass therethrough the gas-infused liquid under a pressure of at least 20 psi, wherein a surface of the flow path configured to engage the gas-infused liquid flowing through the flow path is formed of material having a surface roughness (Ra) in a range of 0.1 μm-10.0 μm; and a nozzle which receives the gas-infused liquid after the gas-infused liquid has passed through the tubular flow path and discharges the gas-infused liquid into a receiving liquid while minimizing release of any infused gas; wherein the flow path has a length which is at least 100 times a mean inner diameter thereof, the nozzle comprises a first tube having one end configured to be connected to a source of the gas-infused liquid and a second end from which the gas-infused liquid is discharged, and a second tube which is fixed in surrounding relation to at least a portion of the first tube with a space therebetween and which includes an open discharge end which extends further downstream in a direction of liquid flow through the nozzle than the second end of the first tube, the first tube has an opening defined in a sidewall thereof, the second tube has an opening defined in a sidewall thereof, and the opening in the side wall of the first tube is disposed further downstream in the direction of liquid flow through the nozzle than the opening in the side wall of the second tube, and the nozzle is configured to be at least partially submerged in the receiving liquid when discharging the gas-infused liquid, including the second end of the first tube, the discharge end of the second tube and portions of the first and second tubes having the openings defined in the sidewalls thereof, such that the receiving liquid fills the space between the submerged portions of the first and second tubes.

2. The system for stabilizing gas-infused liquid according to claim 1, wherein the mean inner diameter of the tubular flow path is 0.1 inch to 8.0 inches.

3. The system for stabilizing gas-infused liquid according to claim 1, wherein the length of the flow path is at least 200 times the mean inner diameter thereof.

4. The system for stabilizing gas-infused liquid according to claim 1, wherein the tubular flow path is configured to cause the gas-infused liquid to flow therethrough in a substantially smooth and laminar manner.

5. The system for stabilizing gas-infused liquid according to claim 4, wherein the tubular flow path is linear or curved.

6. The system for stabilizing gas-infused liquid according to claim 1, wherein the tubular flow path is made of stainless steel.

7. The system for stabilizing gas-infused liquid according to claim 1, wherein the tubular flow path is configured to receive and pass therethrough the gas-infused liquid under a pressure in a range of 20 psi to 10,000 psi.

8. The discharging nozzle according to claim 1, wherein when the nozzle is at least partially submerged in the receiving liquid discharge of the gas-infused liquid from the first tube creates a draft of the receiving liquid through the opening in the sidewall of second tube and the space between the first and second tubes.

9. The discharging nozzle according to claim 1, wherein the second tube has another end which is closed, while the discharge end of the second tube extends further downstream by at least 0.50 inch in the direction of liquid flow through the nozzle than the second end of the first tube.

10. The discharging nozzle according to claim 8, wherein an area of the opening in the side wall of the first tube is 20-35% of a cross sectional area of an inner circumference of the first tube.

* * * * *